United States Patent [19]

Wartelle

[11] 4,253,381

[45] Mar. 3, 1981

[54] HYDRAULIC MACHINE OF THE MULTICYLINDER DRUM TYPE

[75] Inventor: Claude Wartelle, Gouvieux, France

[73] Assignee: Centre Technique des Industries Mechaniques, Senlis, France

[21] Appl. No.: 45,240

[22] Filed: Jun. 4, 1979

[30] Foreign Application Priority Data

Jun. 2, 1978 [FR] France ..... 78 16506

[51] Int. Cl.[3] ..... F01G 13/02

[52] U.S. Cl. ..... 91/506

[58] Field of Search ..... 91/504–507, 91/484–488, 499

[56] References Cited

U.S. PATENT DOCUMENTS

| | | | |
|---|---|---|---|
| 2,397,314 | 3/1946 | Grosser | 91/485 |
| 3,108,543 | 10/1963 | Gregor | 91/505 |
| 3,168,009 | 2/1965 | Orao | 91/507 |
| 3,556,683 | 1/1971 | Schott et al. | 91/484 |
| 3,682,046 | 8/1972 | Garcea et al. | 91/499 |
| 3,722,372 | 3/1973 | Freese | 91/504 |
| 3,796,137 | 3/1974 | Thoma | 91/507 |
| 4,075,933 | 2/1978 | Stephens | 91/506 |

FOREIGN PATENT DOCUMENTS

| | | | |
|---|---|---|---|
| 1208256 | 1/1960 | France | 91/507 |
| 1193704 | 6/1970 | United Kingdom | 91/488 |
| 1260293 | 1/1972 | United Kingdom | 91/499 |

*Primary Examiner*—William L. Freeh

*Attorney, Agent, or Firm*—McDougall, Hersh & Scott

[57] ABSTRACT

A multicylinder hydraulic machine of the split-shaft kind comprises a rotatable shaft and a drive plate fixed on the shaft and linked to piston and rod units received in the cylinders of the drum. Liquid flow is through orifices in a distribution plate non-rotatably positioned around the shaft, through ducts in the drive plate and through the piston and rod units which are hollow. The shaft is rotatably mounted and axially located by conical bearings. The distribution plate is mounted in an axially floating manner and a hydraulic abutment is developed between the distribution plate and the drive plate during operation of the machine so as to reduce the force on the shaft bearings.

9 Claims, 5 Drawing Figures

100
24
2
52
88
38
90
32'
32
54
58
60
10
70
4
2
28
56
Y
26
30
6
8
62
64
18
16
14
F
66
65
8
70
58'
60'
88
82
38
36
40

HYDRAULIC MACHINE OF THE MULTICYLINDER DRUM TYPE

BACKGROUND OF THE INVENTION

The invention relates to a hydraulic machine which can operate as a pump or motor and which is of the multicylinder drum type having a variable cylinder capacity.

A machine of this type has a rotatable shaft and a drive plate linked to piston and rod units received in the cylinders of the drum.

There are of course two kinds of hydraulic machine of this type: the so-called in-line machine in which the drum is rigidly secured axially to the shaft and the inclination of the drive plate relative to the shaft is variable; and the so-called split-shaft machine in which the drive plate is rigidly secured to the shaft and the drum can be inclined relative to the shaft.

This invention concerns a split-shaft machine of the second kind in which: the ends of the rods of the piston and rod units are pivotally received in spherical sockets provided in the surface of the drive plate facing the drum; each piston and rod unit is formed with a longitudinal liquid flow duct extending from the ends of the rod to the piston head; a liquid flow duct extends through the drive plate from the base of each of the spherical sockets to the opposite surface of the plate; the opposite surface of the plate bears on a distribution plate which is fixed in rotation, extends around the shaft and is pierced with at least one liquid flow orifice opposite which the ducts in the drive plate terminate; and stationary liquid flow conduit means is connected to each distribution plate orifice.

A machine of the foregoing construction obviates the need for the rotating hydraulic seal required at the fluid inlet and outlet of the drum because the latter is of variable inclination. Previously, in known machines of this kind, the fluid entered and left the drum via the inside of the drum-tilting pivots, so that a rotating seal had to be provided.

However, in the known split-shaft machines the force of the pistons is transferred to the bearings of the shaft which therefore have a limited working life and limited working pressures.

The present invention aims to provide a reduction in the forces applied to the shaft bearings and thereby the possibility of operating at higher pressures than has previously been possible.

SUMMARY OF THE INVENTION

In the improved machine of the present invention: the shaft is rotatably mounted in the frame of the machine by at least one mechanical abutment, such as a conical roller bearing, which fixes the axial position of the shaft and the said opposite surface of the drive plate in the frame; and the distribution plate is non-rotatably mounted in an axially floating condition around the shaft so that, during operation of the machine, a hydraulic abutment is established between the said opposite surface of the drive plate and the adjacent face of the distrubition plate, the said hydraulic abutment reducing the force to which the mechanical abutment is subjected.

Preferably, the passages via which the liquid enters and leaves each cylinder take the form solely of the longitudinal duct in each corresponding piston and rod unit, i.e., there is a two-way flow of liquid in each of the latter ducts. In this embodiment, for instance, in the case of a machine working as pump, the flow of liquid on intake and on delivery is to and from each cylinder through the same duct, i.e., the one in the corresponding rod.

One of the advantages of this feature is to make the paths for the liquid in the pump more direct. In this embodiment, the stationary distribution plate is pierced with two liquid flow orifices (one for intake and one for delivery in the case of a pump) opposite which the ends of the ducts in the drive plate pass as the machine rotates.

In another embodiment, liquid flows through the longitudinal ducts in the rods only in one direction, for instance, from the cylinders towards the stationary distribution plate in the case of a pump. In this event each cylinder end is pierced with a liquid flow orifice each passing consecutively by a distribution orifice in the bearing plate (which is fixed in rotation but which can be inclined to the shaft axis to vary the cylinder capacity) on which that radial surface of the rotary drum which is near the cylinder ends bears in rotation in conventional manner.

In this latter embodiment the low-pressure liquid comes from or is collected in a stationary hermetic casing around the drum or barrel.

In both embodiments, rotating inlet and outlet liquid seals are obviated.

BRIEF DESCRIPTION OF THE DRAWINGS

The invention will be better understood from the following detailed description and from the accompanying drawings which illustrate embodiments of the invention by way of non-limitative example and in which.

DESCRIPTION OF PREFERRED EMBODIMENTS

Figure 1:
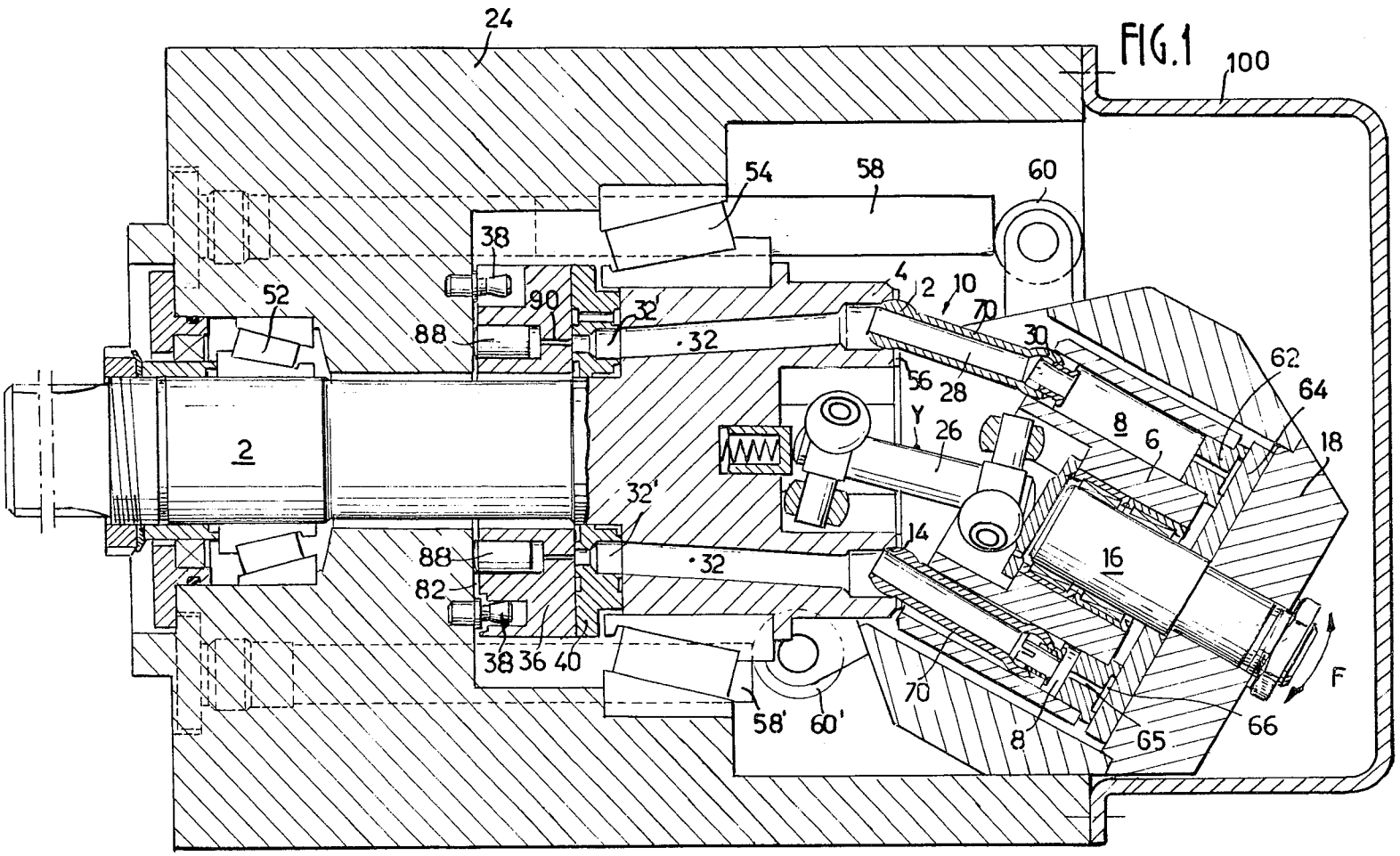
FIG. 1 is a view in longitudinal section of a pump-/motor according to the invention.

Although the machine shown in FIGS. 1 and 2 can work as a pump or motor of variable cylinder capacity, the term "pump" will simply be used hereinafter, the term of course covering both forms of operation.

The pump according to the invention comprises the following elements which are conventional in known split shaft pumps; a shaft 2; a drive plate 4 rigidly secured and perpendicular thereto; a rotating drum or barrel 6 formed with a ring of cylinders 8, for instance seven cylinders; and piston and rod units 10 having spherical rod ends 12 pivotally received in correspondingly shaped recesses or sockets 14 in the plate surface which is near the drum 6.

Drum 6 is rotatably mounted on a pivot shaft 16 carried by a drum support plate 18 which is fixed in rotation but which can tilt in the direction indicated by an arrow F in FIG. 1 relative to the axis of shaft 2. Plate 18 is carried by a yoke-like locking frame comprising two arms 20, 20' which can be seen in FIG. 2 and which pivot on two pivots 22, 22' extending along the axis YY' and borne by pump frame 24.

A universal synchronizing joint 26 is interposed between plate 4 and drum 6.

Each piston and rod unit 10 is hollow and has a longitudinal liquid flow duct 28 extending at one end into the cylinder via the piston head 30 and at the other end through the spherical head or end 12 of the rod.

At the base each recess 14 the plate 4 is pierced with a liquid flow duct 32 which extends to that radial surface 34 of the drive plate which is opposite the surface formed with the spherical recesses 14.

Surface 34 could bear directly on a distribution plate 36 which is maintained fixed in rotation around shaft 2 by pins or the like 38 engaged in the casing 24 (FIG. 1). For technological reasons, however, it is preferable to interpose a ring 40 made of low-friction metal between the drive plate 4 and the distribution plate 36, ring 40 rotating solidly with the drive plate 4 by way of pins 42. Ring 40 is pierced with orifices 32' registering with and prolonging the ducts 32 (FIG. 2).

Figure 2:
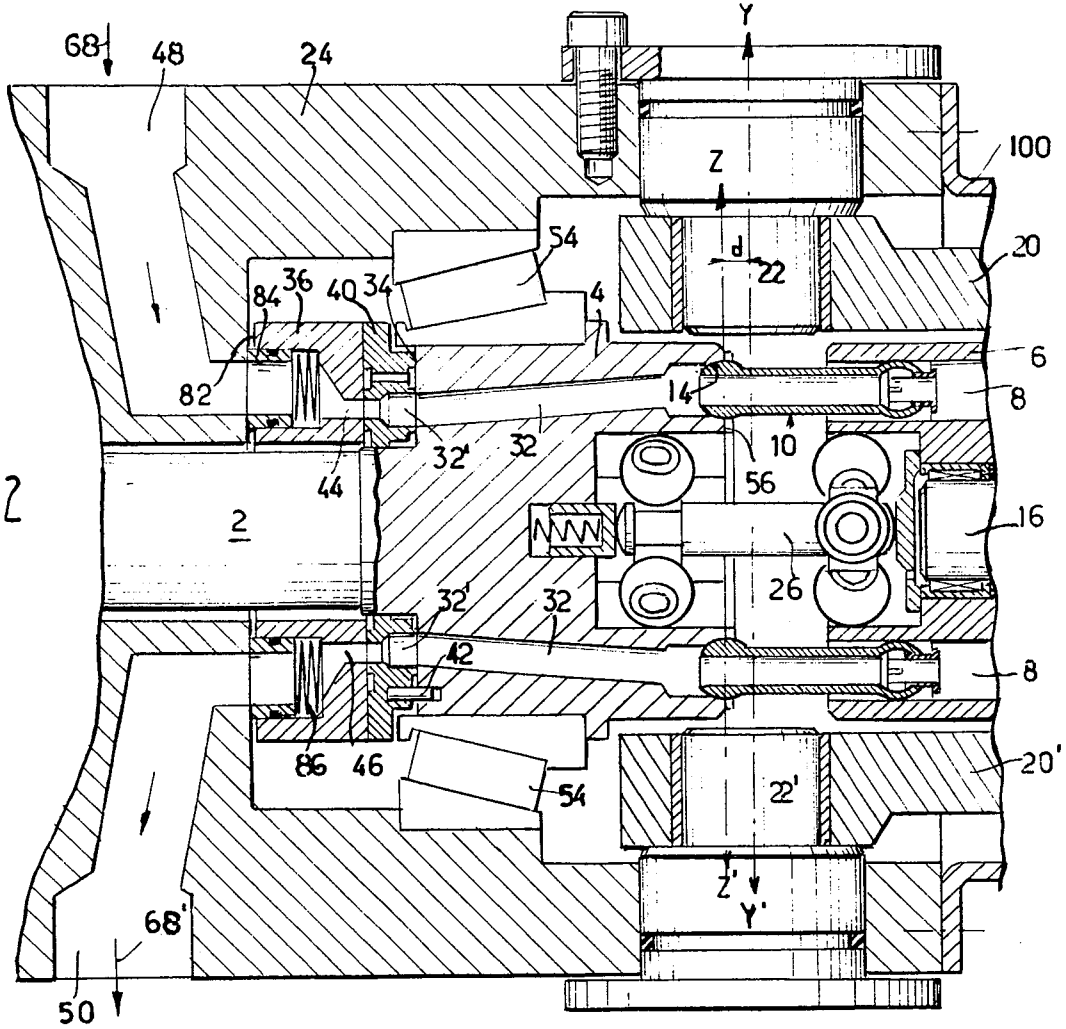
FIG. 2 is a partial view in longitudinal section of the same machine but in a plane perpendicular to the plane of FIG. 1.

In the embodiment shown in FIGS. 1 and 2 the distribution plate 36 is formed with two orifices 44, 46 past which the ends of the orifices 32' prolonging the ducts 32 move when the machine rotates. Two stationary ducts 48, 50 (FIG. 2) one for intake and one for delivery, are contrived in frame 24 and communicate with the respective orifices 44, 46 in the plate 36.

The shaft 2 and the drive plate 4 rigidly secured thereto are rotatably mounted in frame 24 by means of conical bearings 52, 54. The rod ends 12 are pulled into engagement with their recesses 14 by a perforate plate 56. Sliding push rods 58, 58' which can be seen in FIG. 1 and which bear on rollers 60, 60' on the locking frame 18, 20 of the drum serve to adjust the tilt of the drum relative to the axis of shaft 2 to vary the cylinder capacity of the machine. The rods 58, 58' can be operated manually or hydraulically.

The ends of cylinders 8 are closed by plugs 62 of a low-friction metal, the ends of the plugs 62 bearing on a ring 64 which is fixed in rotation and rigidly secured to the plate 18. Preferably, each plug 62 is formed with a narrow duct 65 and a chamber 66 for the production of a hydrostatic pad or cushion between the rotating drum and the bearing elements 64, 18 which are fixed in rotation; however, in the embodiment described with reference to FIGS. 1, 2 and 3 there is no flow of liquid at this end of the cylinders 8 through the ducts 65 (disregarding leakages), the latter ducts serving merely as pressure take-offs.

Operation of the pump according to the invention is clear enough from the foregoing description for it to suffice to state that, when the drum is in its position of maximum tilt shown in FIG. 1 and when the shaft 2 is rotating, delivery is at a maximum, for instance, in the direction indicated by arrows 68, 68' (FIG. 2) marked in the ducts 48, 50. Clearly, in this embodiment the only flow of oil to and from the cylinders 8 is by way of the ducts 32', 32, 28 through the drive plate and the rods. Consequently, the oil flow direction in the channels reverses at each half-revolution of the shaft. Clearly too, the oil has a very direct path through the ducts, the path being of large cross-section, even through the rods. As will be seen subsequently, special features can be provided so that the rods can be of considerable diameter but not limit the tiltability of the drum, i.e. variations of cylinder capacity.

Of course, when drum tilt is decreased by means of the members 58, 58', delivery decreases to become zero when the drum axis is in extension of the axis of shaft 2, the direction of delivery reversing when the drum tilts beyond the zero-delivery position.

When the machine runs as a motor, therefore, it is a variable-speed reversible motor.

Since the fluid enters and exits by way of stationary ducts 48, 50 in the machine frame, there is no rotating hydraulic seal, in contrast to some known variable cylinder capacity pumps of this kind, in which the liquid enters and/or exits through rotating hydraulic seals in the drum frame pivots 22, 22' due to the cylinders being carried by the pivoting drum. The construction of the machine is thereby simplified and the risk of leakages is reduced.

In conventional split-shaft pumps the force of the pistons is transferred to the rolling shaft bearings, which therefore have to be substantial and deal with heavy loads and have a limited working life, and also limited working pressures.

In a pump according to this invention this disadvantage is obviated by hydrostatic balancing of the shaft 2 by means of a floating mounting of the surface 36. As can be seen in FIGS. 1 and 2, the distribution plate 36, which is retained in rotation by the pins or the like 38, acts like a ram and can move axially, e.g. by from 0.5 to 1 mm, relative to the pump casing to obviate a hydrostatic lift relative to the shaft bearing, so that the novel pump or motors can be operated at higher pressures than previously.

Also, because oil flows through the rods and the ducts 32, there is continuous lubrication of the swivel joints of the rod ends 12.

In one simple embodiment, each piston and rod unit can take the form of two pierced balls (which can be made to great accuracy and at low cost), one ball forming the swivel of the rod end 12 and the other forming the end of piston 30, the balls being welded or brazed to the hollow rod 70. This system experiences purely compression, tensile forces occurring only on intake at a low liquid pressure.

Figure 3:
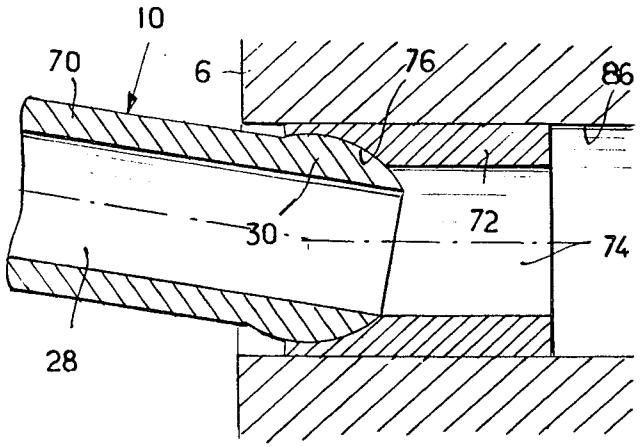
FIGS. 3 and 4 are partial views in section of two embodiments of piston and rod units.
Figure 4:
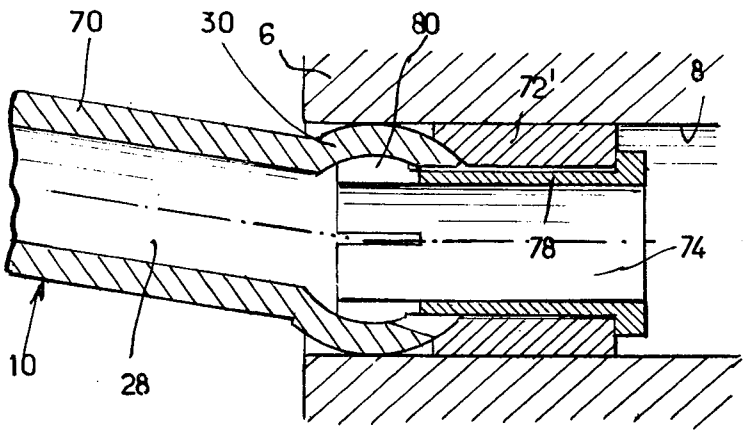

Preferably, and as shown in FIGS. 3 and 4, the spherical end 30 of the hollow rod 70 forming the rod has a segment for providing sealing tightness in the cylinder 8. As FIG. 3 shows, the segment takes the form of a short tubular member 72 having a central duct 74 which extends duct 28 of rod 70. Duct 74 merges into a spherical recess 76 which is engaged over the spherical end 30 of the rod to form a swivel joint.

In the variant shown in FIG. 4, a sleeve 72' forming the segment is retained on the spherical head 30 of the rod by a split socket 78 whose split skirt 80 has a spherical external shape engaging and latching in the inside of head 30. A swivel joint is therefore provided between the segment and the rod while providing an uninterrupted passage 28, 74 for the liquid to and from the cylinder 8.

In this system the guiding function, provided by the rod end 30, is separated from the sealing function, provided by the segment 72' which serves as the piston head.

As previously stated, it is preferred to use hollow rods of large diameter for the sake of having large flow cross-sections for the oil and for the rods to have a good buckling strength.

The large diameter of the rods might cause difficulties because of the risks of the rods interfering with the cylinder inside walls at large angles of drum tilt (see rod 70 of the bottom cylinder in FIG. 1), so that the angle of tilt would be limited and, therefore, so would the possible variations of cylinder capacity. In conventional split-shaft pumps the drum tilt is usually limited to an angle of approximately 25°. According to the invention and although the rods are of large diameter, drum tilt can be up to 30° in the drum position shown in FIG. 1 for a 9-cylinder pump and 35° for a 7-cylinder pump.

This advantage is achieved because the pivoting axis YY' of the drum (FIG. 2) is disposed in the articulation plane 22' of the rod ends as is the case in conventional split-shaft pumps, but offset from such plane towards the radial surface opposite the drum by a distance d of the order of from 25 to 33% of the distance between the plane ZZ' and the latter radial surface. Consequently, all the cylinders can have their axes parallel, so that drum production is cheapened and becomes more accurate.

Despite the clearance 82 between the distribution plate 36 and the pump casing, the sealing of the passage between the orifices 44, 46 in the plate 36 and the ducts 48, 42 in the pump casing is provided by ring seals 84 which are urged into engagement with the pump casing by springs 86 (FIG. 2). In another embodiment of the invention, two small rams 88 can be contrived in the thickness of the surface 36 (FIG. 1) and be cyclically energized by pressure oil through narrow ducts 90 when the ends 32' of the ducts 32 pass by the ducts 90, to apply the distribution plate 36 to the drive plate and completely balance piston thrust.

A pump such as the one described can be designed for a maximum pressure of 1000 bars with a rated pressure of 400 bars at a speed of 1500 rpm. The most advantageous cylinder numbers are 7, 9 and 11.

In another form of the invention, a hollow-rod pump can be provided which requires no rotating hydraulic seal but in which the oil flow through the hollow rods and the ducts 32 of the drive plate is always in the same direction. This construction, of use for pumps used on open circuit, is partially shown in FIG 5. The pump parts not shown therein are identical to those shown in FIGS. 1 and 2 except that the surface 36 is formed with only one distribution orifice 46 instead of two and there is only one oil flow duct 50 in the pump casing 24.

Figure 5:
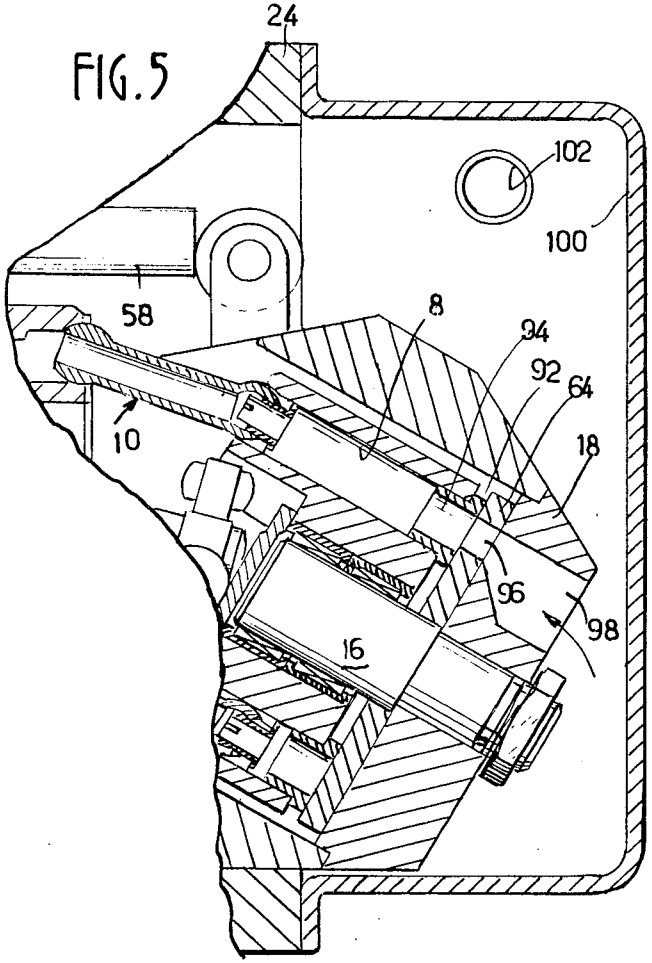
FIG. 5 is a partial view in longitudinal section, and in the same plane as FIG. 1, of a constructional variant.

The only other modification concerns the drum, which is shown in FIG. 5. The ends of the cylinder 8 are not closed by plugs but have short tubular members 92 which are made of a low-friction metal and which are pierced with a wide passage 94. The intermediate drum support plate 64 is pierced with an intake port or orifice 96 which is connected to a wide intake passage 98 in the plate 18. The case 100 protecting the drum has an oil inlet 102.

In this system the intake is directly into the casing, oil being taken in on the drum side and delivered on the side of the surface 36. All the advantages previously described are retained and intake capacity is improved; however, in this embodiment the tilt of the drum cannot be reversed to reverse the flow direction.

I claim:

1. A hydraulic machine of the multicylinder drum type having a variable cylinder capacity, the machine being of the split-shaft kind and comprising:

a machine frame;

a shaft rotatably mounted in the frame;

a rotatable drum having a plurality of cylinders and an inclination which can be varied relative to the shaft;

a drive plate rigidly secured to the shaft with one surface facing the drum, the one surface being formed with a plurality of spherical sockets and a liquid flow duct being pierced through the plate to the opposite surface thereof from the base of each spherical socket;

a synchronisation joint interconnecting the drive plate and the drum;

piston and rod units each having a piston head received in a respective cylinder of the drum and a rod end pivotally received in a respective spherical socket of the one surface of the drive plate, each piston and rod unit being hollow and comprising a longitudinal liquid flow duct extending from the rod end to the piston head of the unit;

a distribution plate which is fixed in rotation and extends around the shaft and against which the said opposite surface of the drive plate bears, the distribution plate being pierced with at least one liquid flow orifice opposite which the liquid flow ducts of the drive plate terminate; and means defining a stationary liquid flow conduit connected to each orifice of the distribution plate;

in which machine the improvement comprises:

the shaft being rotatably mounted in the frame by at least one mechanical abutment which fixes the axial position of the shaft and the said opposite surface of the drive plaate in the frame; and said non-rotatable distribution plate being mounted in an axially floating condition around the shaft and being arranged so that, during operation of the machine, a hydraulic thrust bearing established between the said opposite surface of the drive plate and the adjacent face of the distribution plate, the said hydraulic thrust bearing reducing the force to which the mechanical abutment is subjected.

2. A machine according to claim 1, of reversible type, wherein: the longitudinal ducts in each piston and rod unit and the corresponding ducts pierced through the drive plate are ducts for the two-way flow of the liquid, such ducts forming at the same time the liquid intake and delivery ducts in each cylinder; the distribution plate is pierced with a liquid intake orifice and a liquid delivery orifice; and a stationary liquid intake duct and a stationary liquid delivery duct are devised in the frame of the machine and are connected to the intake and delivery orifices respectively.

3. A machine according to claim 2, wherein the liquid intake and delivery ducts in each cylinder are formed solely by the aforementioned longitudinal duct in each corresponding piston and rod unit.

4. A machine according to claim 1, wherein a sealing segment a portion of whose section is substantially spherical is mounted on the sphere forming the piston head of the piston and rod unit.

5. A machine according to claim 4 wherein the sealing segment is formed by a sleeve having a spherical recess engaged over the spherical end of the piston head and wherein a split socket is telescoped inside the sleeve, said socket including a partly spherical end which latches in the inside of the spherical head of the piston.

6. A machine according to claim 1, wherein the radial face of the drum disposed on the side of the cylinder base bears rotatably against a support plate which is fixed in rotation but which can tilt in relation to the axis of the shaft, the plate being carried by a yoke-like two-armed tilting frame which is mounted to pivot around an axis fixed in space and perpendicular to the axis of the shaft.

7. A machine according to claim 6, wherein the pivoting axis of the tiltable frame is offset in relation to the plane of swivelling articulation of the rod ends, such axis lying in a position intermediate between the plane and radial face of the drum opposite such plane.

8. A machine according to claim 6, wherein: the longitudinal ducts in each piston and rod unit and the corresponding ducts pierced through the drive plate are ducts for the unidirectional flow of the liquid; the distributing surface is pierced with a single liquid flow orifice which is connected to a single fixed liquid flow duct devised in the frame of the machine; the base of each cylinder is pierced with a liquid flow orifice cyclically closed by such cylinder base bearing against the bearing plate of the drum; and such bearing plate is pierced with a distribution orifice opposite which the orifices of the cylinder bases pass cyclically.

9. A machine according to claim 8, wherein the duct devised in the frame of the machine is the high pressure liquid duct; the orifice in the bearing plate is the low pressure liquid duct; such orifice communicates directly with the inside of a sealing-tight casing enclosing the machine, such casing having a low pressure liquid flow orifice; and the two arms of the tiltable frame of the bearing plate are free from liquid flow ducts.

* * * * *